US010093404B1

(12) United States Patent
Mariansky

(10) Patent No.: US 10,093,404 B1
(45) Date of Patent: Oct. 9, 2018

(54) ROWING APPARATUS

(71) Applicant: Reynaldo Mariansky, Sacramento, CA (US)

(72) Inventor: Reynaldo Mariansky, Sacramento, CA (US)

( * ) Notice: Subject to any disclaimer, the term of this patent is extended or adjusted under 35 U.S.C. 154(b) by 0 days.

(21) Appl. No.: 15/942,950

(22) Filed: Apr. 2, 2018

(51) Int. Cl.

| | |
|---|---|
| ***B63H 16/18*** | (2006.01) |
| ***B63H 16/08*** | (2006.01) |
| ***B63H 1/32*** | (2006.01) |
| ***B63H 16/10*** | (2006.01) |
| *B63H 16/04* | (2006.01) |

(52) U.S. Cl.
CPC ..... *B63H 16/18* (2013.01); *B63H 1/32* (2013.01); *B63H 16/08* (2013.01); *B63H 16/10* (2013.01); *B63H 16/04* (2013.01)

(58) Field of Classification Search
CPC ..... A63B 35/00; B63H 16/00; B63H 16/08; B63H 1/00; B63H 1/32
USPC ..... 440/17, 19, 21, 25
See application file for complete search history.

(56) References Cited

U.S. PATENT DOCUMENTS

| | | | | |
|---|---|---|---|---|
| 314,001 | A * | 3/1885 | Doscher | B63H 1/32 440/19 |
| 1,528,702 | A | 11/1894 | Vogel | |
| 1,340,920 | A * | 5/1920 | Talbot | B63H 16/08 440/25 |
| 2,026,888 | A * | 1/1936 | Granger | B63H 1/32 440/19 |
| 2,918,891 | A * | 12/1959 | Klabunde | B63H 1/32 440/17 |
| 3,677,216 | A | 7/1972 | Gentemann | |
| 3,967,574 | A | 7/1976 | Golden | |
| 4,002,137 | A | 1/1977 | Vrana | |
| 4,098,219 | A | 7/1978 | Tesan | |
| 4,472,147 | A * | 9/1984 | Jimenez | A63B 35/00 440/17 |
| 5,041,037 | A | 8/1991 | Jaw | |
| 7,520,788 | B1 | 4/2009 | Gonzalez | |
| 7,922,549 | B1 | 4/2011 | Sirota et al. | |
| 2016/0096605 | A1 | 4/2016 | Varan | |
| 2016/0244136 | A1 | 8/2016 | Ketterman et al. | |

FOREIGN PATENT DOCUMENTS

| | | |
|---|---|---|
| GE | 313815 | 6/1929 |

* cited by examiner

*Primary Examiner* — Lars A Olson
(74) *Attorney, Agent, or Firm* — Thomas R. Lampe

(57) ABSTRACT

Boat rowing apparatus including a framework having spaced horizontal flotation members disposed outside the boat sides and extending into the body of water supporting the boat. A plurality of spaced paddle members are pivotally mounted on the flotation members to propel the boat when the framework is moved back and forth by a rower.

8 Claims, 5 Drawing Sheets

ROWING APPARATUS

TECHNICAL FIELD

This invention relates to rowing apparatus employed with a boat for manually propelling the boat.

BACKGROUND OF THE INVENTION

The use of paddles and oars to propel boats goes back to the pre-history era of mankind. A wide variety of devices for doing so have been devised.

Some prior art rowing arrangements have utilized a plurality of paddles which are simultaneously actuated by a person rowing. Such devices are normally a physical part of the boat structure; that is, the rowing systems are positively connected to or an integral part of the boat.

The following patent documents are believed to be representative of the current state of the prior art in this field: U.S. Pat. No. 7,520,788, issued Apr. 21, 2009, U.S. Pat. No. 7,922,549, issued Apr. 12, 2011, U.S. Pat. No. 5,041,037, issued Aug. 20, 1991, U.S. Pat. No. 4,098,219, issued Jul. 4, 1978, U.S. Pat. No. 4,002,137, issued Jan. 11, 1977, U.S. Pat. No. 3,967,574, issued Jul. 6, 1976, U.S. Pat. No. 3,677,216, issued Jul. 18, 1972, U.S. Pat. No. 528,702, issued Nov. 6, 1894, U.S. Patent Application Pub. No. US 2016/0244136, published Aug. 25, 2016, U.S. Patent Application Pub. No. US 2016/0096605, published Apr. 7, 2016 and British Patent No. 313,815, issued Jun. 20, 1929.

DISCLOSURE OF INVENTION

By way of contrast with the prior art, the rowing apparatus of the present invention is in the nature of a rowing system which can readily be positioned in association with the boat or removed therefrom in its entirety. The structural elements of the rowing apparatus can readily be disassembled for storage or other purposes and readily reassembled for use and positioned in operative association with the boat.

One or more of the rowing apparatuses of the present invention can be employed with a boat.

The term "boat" as employed herein refers to any type of suitable known water vessels, including canoes, conventional row boats, etc.

The rowing apparatus of this invention is employed with a boat for manually propelling the boat, the boat having sides forming an open topped boat interior.

The rowing apparatus includes a framework for operative association with the boat. The framework includes a pair of spaced, elongated vertical frame members having upper end portions and lower end portions, an elongated connector extending between and connecting the upper end portions, and a pair of buoyant elongated, spaced horizontal flotation members attached to the lower end portions and projecting therefrom.

A plurality of spaced paddle members are pivotally mounted on each of the buoyant elongated, spaced horizontal flotation members at locations thereon positioned away from the spaced, elongated vertical frame members.

The framework when in operative association with the boat has the elongated connector thereof extending across the boat interior over the boat sides and the spaced, elongated vertical frame members and the buoyant elongated, spaced horizontal flotation members are disposed outside the boat sides and extend to the water which supports the boat.

The framework when in operative association with the boat is manually moved back and forth by a rower in the open topped boat interior relative to the boat and causes pivotal movement of the paddles between a propelling position wherein the paddles extend downwardly away from the buoyant elongated, spaced horizontal flotation members and a non-propelling position wherein the paddles are disposed and extend alongside the spaced horizontal flotation members.

Other features, advantages and objects of the present invention will become apparent with reference to the following description and accompanying drawings.

MODES FOR CARRYING OUT THE INVENTION

Figure 6:
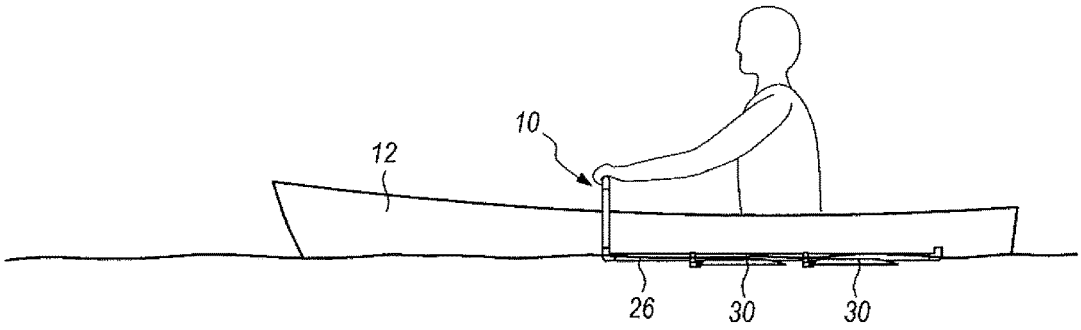
FIG. 6 is a side elevation view showing a rower in a boat with the paddles in non-propelling position.
Figure 7:
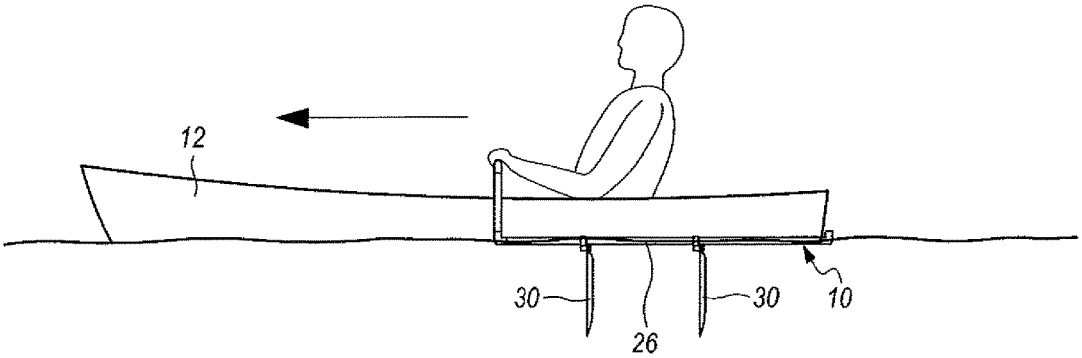
FIG. 7 is a view similar to FIG. 6, but showing the paddle members in propelling position and employed to move the boat in the direction of the arrow.

Referring now to FIGS. 1-7, rowing apparatus 10 constructed in accordance with the teachings of the present invention is illustrated. FIGS. 1-4, 6 and 7 show the apparatus 10 in assembled condition. FIGS. 6 and 7 illustrate the apparatus 10 being used by a rower in a boat 12.

The apparatus 10 may be employed with a boat of any conventional type or construction having boat sides forming an open topped boat interior to accommodate the rower.

Rowing apparatus 10 includes a framework 14 constructed of any suitable material such as metal or plastic tubing. Conventional elbows 16 may be utilized to connect the tubing components together.

The framework 14 includes a pair of spaced, elongated vertical frame members 18 having upper end portions 20 and lower end portions 22.

An elongated connector 24 extends between the upper end portions 20 and is releasably connected by elbows 16 to the upper end portions by support shafts 25 projecting from the elbows which are inserted into the ends of elongated connection 24, the elongated connector being in slidable engagement with the support shafts. This allows the distance between vertical frame members to be adjusted allowing use of the rowing apparatus or boats of different widths.

A pair of buoyant elongated, spaced horizontal flotation members are attached by elbows 16 to the lower end portions 22 and project therefrom. The flotation members 26 are disposed substantially parallel to one another. The free distal ends of the flotation members are closed, for example by an L-shaped end cap 28.

A plurality of spaced paddle members 30 are pivotally mounted on each of the flotation members 26 by pivot hinge structures 32 at locations on the flotation member located away from the vertical frame members 18.

The framework 10 when in operative association with a boat such as boat 12 has the elongated connector 24 thereof extending across the boat interior over the boat sides. The elongated vertical frame members 12 and the flotation members 26 extend to the water supporting the boat.

Figure 1:
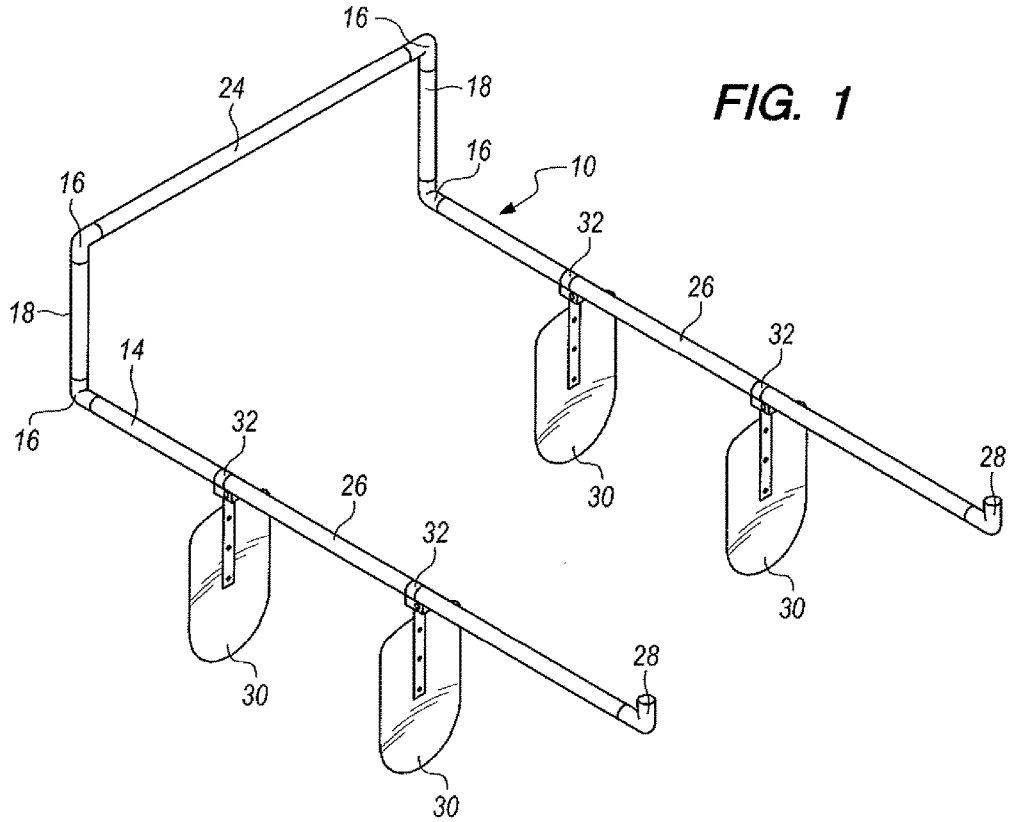
FIG. 1 is a top perspective view illustrating the apparatus in assembled condition and the paddle members thereof in propelling position.
Figure 2:
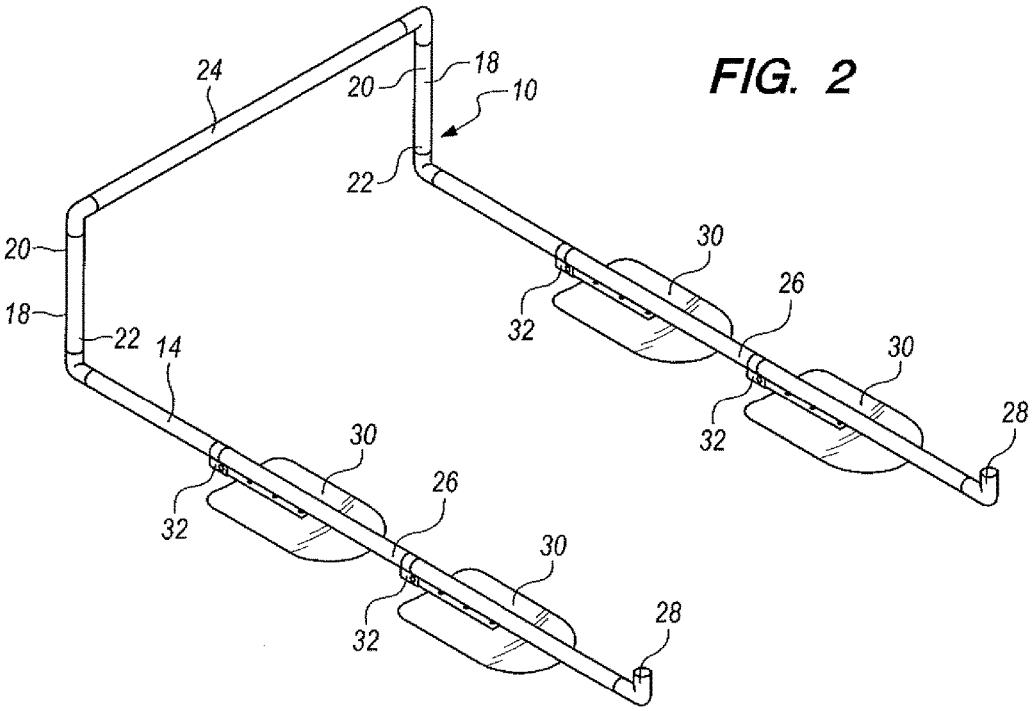
FIG. 2 is a view similar to FIG. 1, but illustrating the paddle members in non-propelling position.
Figure 3:
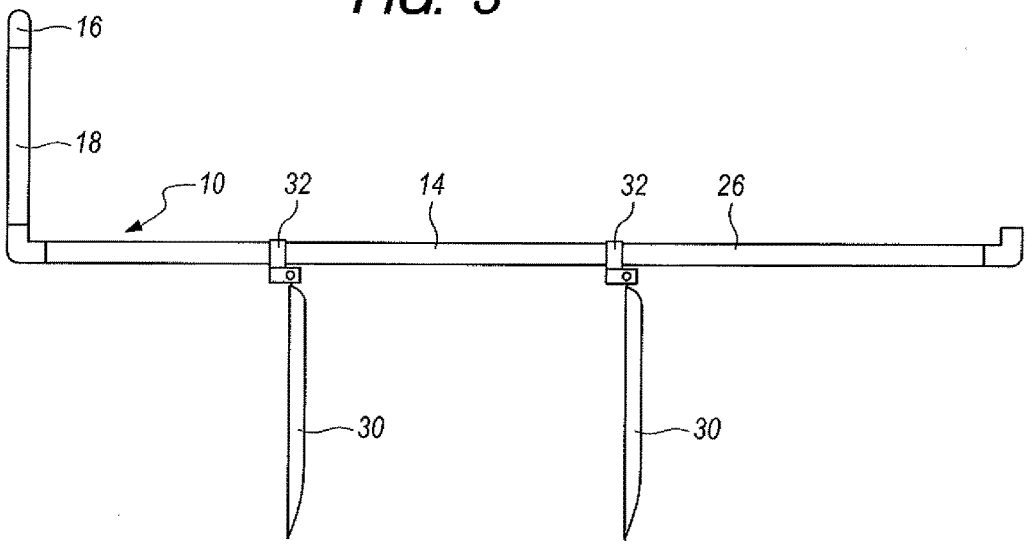
FIG. 3 is a side elevational view showing the paddle members in downwardly extending and propelling position.
Figure 4:
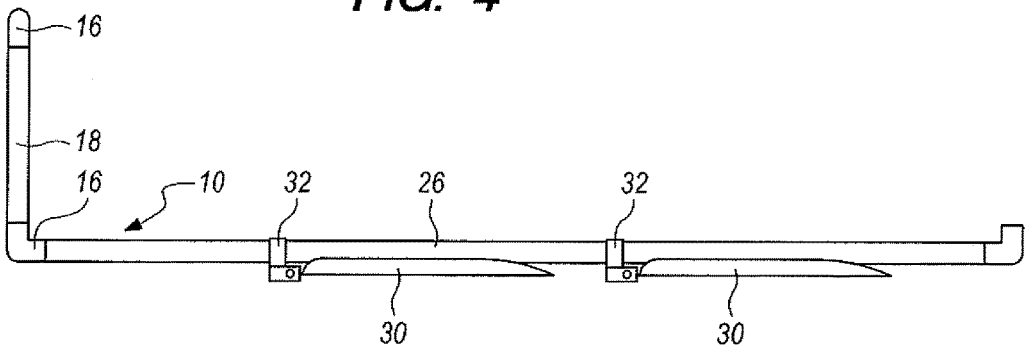
FIG. 4 is a side elevational view showing the paddle members in non-propelling position.
Figure 5:
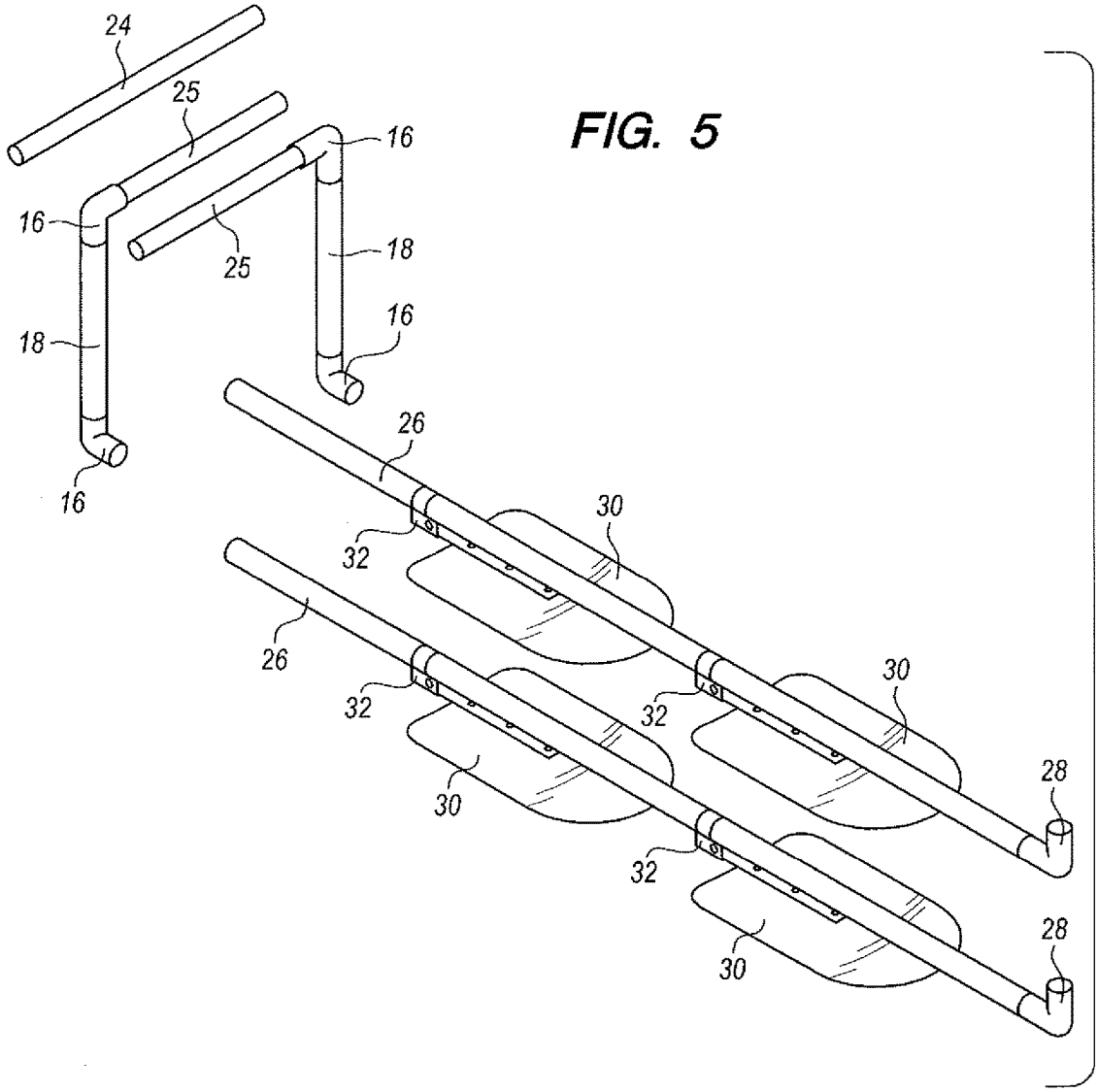
FIG. 5 is a perspective view illustrating the rowing apparatus in disassembled condition.

When the rowing apparatus is in operative association with the boat the framework 14 is manually movable back and forth by a rower in the open topped boat interior relative to the boat, and pivotal movement of the paddle members caused to pivot between a propelling position (shown in FIGS. 1, 3 and 7) wherein the paddle members extend downwardly from the flotation members 26 and a non-propelling position disposed and extending alongside the flotation members 26 (as shown in FIGS. 2, 4 and 6). During rowing, the elongated connector 24 is manually grasped by the rower to manually move the rowing apparatus back and forth, a function which is facilitated by the lack of direct mechanical interconnection between the boat and rowing apparatus, support of the apparatus provided by the flotation members 26 movement along the water.

As indicated above, the rowing apparatus may be disassembled or reassembled and the rowing apparatus is of relatively simple, light weight, easily transportable construction.

Figure 8:
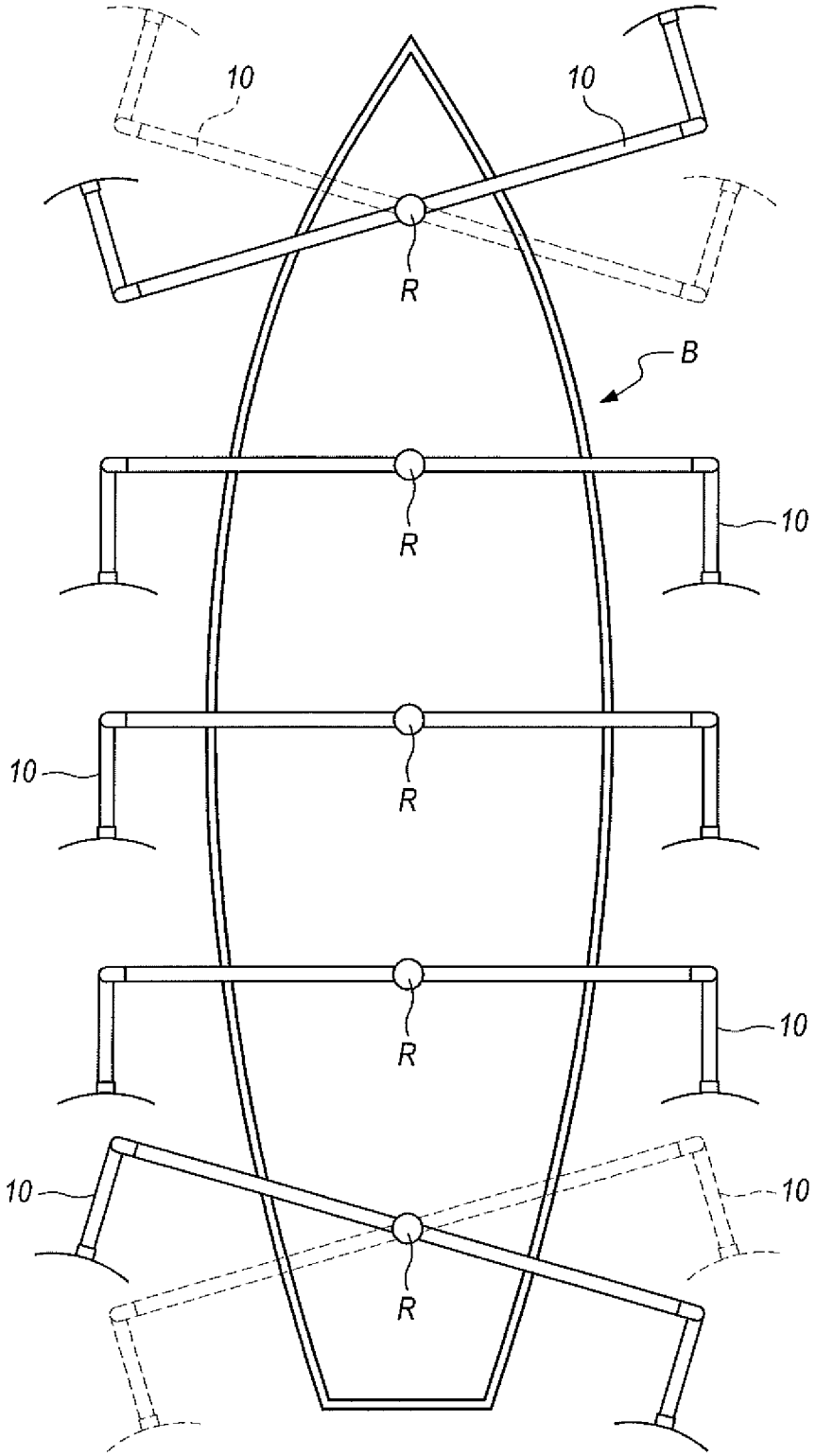
FIG. 8 is a diagrammatic representation of a boat with a plurality of rowers as viewed from above, each rower utilizing a separate apparatus constructed in accordance with the teachings of the present invention.

The rowing apparatus 10 may be one of a plurality thereof positioned along the length of a boat with which it is associated, each rowing apparatus moved by a separate rower. This is indicated in the diagrammatic presentation of FIG. 8 wherein the boat B is relatively large and accommodates five rowers R, each of whom has his or her own rowing apparatus 10. Each rowing apparatus 10 is moved by a separate rower R. In the arrangement depicted in FIG. 8, two of the rowing apparatuses 10 which are located at the stern and bow ends of the boat, can be adjustably canted relative to the primary axis of the boat B between alternative positions indicated by dash and solid lines and employable to steer or otherwise maneuver the boat.

The invention claimed is:

1. Rowing apparatus employed with a boat for manually propelling the boat, the boat having boat sides forming an open topped boat interior, said rowing apparatus comprising:

a framework for operative association with the boat, the framework including a pair of spaced, elongated vertical frame members having upper end portions and lower end portions, an elongated connector extending between and connecting the upper end portions, and a pair of buoyant elongated, spaced horizontal flotation members attached to the lower end portions and projecting therefrom; and a plurality of spaced paddle members pivotally mounted on each of said buoyant elongated, spaced horizontal flotation members at locations thereon positioned away from said spaced, elongated vertical frame members, said framework when in operative association with the boat having the elongated connector thereof extending across the boat interior over the boat sides and the spaced, elongated vertical frame members and said buoyant elongated, spaced horizontal flotation members disposed outside the boat sides and extending to the water which supports the boat, said framework when in operative association with said boat manually movable back and forth by a rower in said open topped boat interior relative to said boat and causes pivotal movement of said paddle members between a propelling position wherein said paddle members extend downwardly away from said buoyant elongated, spaced horizontal flotation members and a non-propelling position wherein said paddle members are disposed and extend alongside said buoyant elongated, spaced horizontal flotation members.

2. The rowing apparatus according to claim 1 wherein said rowing apparatus is one of a plurality thereof positioned along the length of said boat, each rowing apparatus moved by a separate rower.

3. The rowing apparatus according to claim 1 wherein the elongated connector is manually grasped by the rower to manually move the rowing apparatus back and forth.

4. The rowing apparatus according to claim 1 wherein said elongated vertical framework members, said elongated connector and said buoyant elongated, spaced horizontal flotation members are selectively disconnectable for storage or other purposes.

5. The rowing apparatus according to claim 1 wherein said buoyant elongated, spaced horizontal flotation members are hollow tubes.

6. The rowing apparatus according to claim 2 wherein at least one of said rowing apparatuses is large enough to be adjustably canted relative to a primary axis of the boat and employable to steer the boat.

7. The rowing apparatus according to claim 1 wherein said buoyant elongated, spaced horizontal flotation members are disposed substantially parallel to one another.

8. The rowing apparatus according to claim 1 including adjustment structure for varying the distance between said elongated vertical frame members.

* * * * *